United States Patent [19]

Alley et al.

[11] Patent Number: 4,604,552

[45] Date of Patent: Aug. 5, 1986

[54] RETROFIT FLUORESCENT LAMP ENERGY MANAGEMENT/DIMMING SYSTEM

[75] Inventors: Robert P. Alley, Clifton Park, N.Y.; Paul G. Huber, Warwick; Joseph M. Sullivan, Coventry, both of R.I.

[73] Assignee: General Electric Company, Schenectady, N.Y.

[21] Appl. No.: 645,593

[22] Filed: Aug. 30, 1984

[51] Int. Cl.[4] ..... H05B 37/00

[52] U.S. Cl. ..... 315/176; 315/170; 315/175; 315/194; 315/308; 315/DIG. 4; 315/DIG. 7

[58] Field of Search ..... 315/194, DIG. 4, 308, 315/170, 175, 176

[56] References Cited

U.S. PATENT DOCUMENTS

| | | | |
|---|---|---|---|
| 3,969,652 | 7/1976 | Herzog | 315/308 |
| 3,999,100 | 12/1976 | Dendy et al. | 315/308 |
| 4,277,728 | 7/1981 | Stevens | 315/194 |
| 4,350,935 | 9/1982 | Spira et al. | 315/291 |
| 4,371,812 | 2/1983 | Widmayer | 315/291 |
| 4,392,086 | 7/1983 | Ide et al. | 315/DIG. 4 |
| 4,482,844 | 11/1984 | Schweer et al. | 315/194 |

*Primary Examiner*—Harold Dixon

*Attorney, Agent, or Firm*—Mark L. Mollon; James C. Davis, Jr.; Marvin Snyder

[57] ABSTRACT

In a retrofit dimming installation for a fluorescent lighting system with a conventional ballast, filament power is maintained, even when the lamps are dimmed, by providing a high frequency component to the ballast voltage. The selected high frequency component allows heating of the filaments without adding to the light output of the lamps, thereby practically eliminating the shortened lamp life usually resulting from operating the lamp in a dimmed condition.

23 Claims, 15 Drawing Figures

TO BALLAST 13

RETROFIT FLUORESCENT LAMP ENERGY MANAGEMENT/DIMMING SYSTEM

The present invention relates in general to a retrofit fluorescent dimming system for filament heated fluorescent lamps and more specifically to maintaining filament power during lamp dimming.

BACKGROUND OF THE INVENTION

In order to achieve lamp dimming in a pre-existing fluorescent lighting system, it is desirable to limit the required modifications only to the distribution panel. Since the lamp ballast is nearly always inaccessibly mounted in or near the lamp fixture, a retrofit fluorescent dimming system should accomplish dimming using a conventional ballast. It is known in the art to cause dimming of a fluorescent lamp by manipulating the 60 hertz line voltage supplied to the conventional ballast.

One method for manipulating the voltage supplied to the ballast is to notch the input waveform, as shown, for example, by U.S. Pat. No. 4,350,935 to Spira et al. A non-conductive region is formed in the input waveform by opening a series switch for a non-zero portion of each half wave of the input waveform. These periods of zero energy transfer result in a decrease in the RMS voltage applied to the ballast and, therefore, to the lamp, resulting in dimmed light output.

By reducing the RMS voltage applied to the ballast, the previously described notching scheme has the disadvantages that lamp filament power decreases and that cathode drop increases due to the loss of filament heating. As cathode drop increases, fewer electrons are emitted to initiate the plasma building process. Thereafter, electrons tend to be torn from the lamp filaments by field emission, blowing off pieces of the emission mix and leading to hard lamp starting, reduced lamp life, and excessive blackening of the lamp ends. In the circuitry of the aforementioned Spira et al. patent, special precautions must be taken to ensure that the lamps are not started in a dimmed condition. Thus, in Spira et al., the input waveform is not notched until the lamp has reached full operating temperature under full line voltage.

OBJECTS OF THE INVENTION

It is a principal object of the present invention to provide a new and improved method for maintaining filament heating in a retrofit fluorescent dimming system which is not subject to the foregoing disadvantages.

It is another object of the present invention to provide a new and improved dimming circuit for supplying a conventional ballast which maintains adequate filament heating throughout a full range of dimming of about 10:1.

It is an additional object of the present invention to provide overload protection for the lamp dimming circuit components and the system insulation.

It is a further object of the present invention to provide a method and apparatus for dimming conventional lamps and ballasts without subjecting the lamps to adverse conditions leading to hard starting and reduced lamp life.

SUMMARY OF THE INVENTION

These and other objects of the present invention are achieved by a method for maintaining filament heating in a fluorescent dimming system wherein the ballast voltage has a low frequency component having a varied duty cycle during each half wave thereof to dim the fluorescent lamps, the method comprising the step of adding a high frequency component to the ballast voltage, at least during times that the low frequency component is insufficient to maintain filament heating.

In one embodiment, a dimming circuit for connecting between a low frequency AC source and a ballast comprises a power switch for rapidly turning on and off and a control circuit for providing high frequency switching signals to the power switch for controlled intervals during each half cycle of the AC source. In other embodiments, the high frequency component is obtained from a high frequency oscillator.

The features and advantages of the present invention will become apparent from the following detailed description of the invention when read with the accompanying drawings in which applicable reference numerals have been retained.

DETAILED DESCRIPTION OF THE INVENTION

Figure 1:
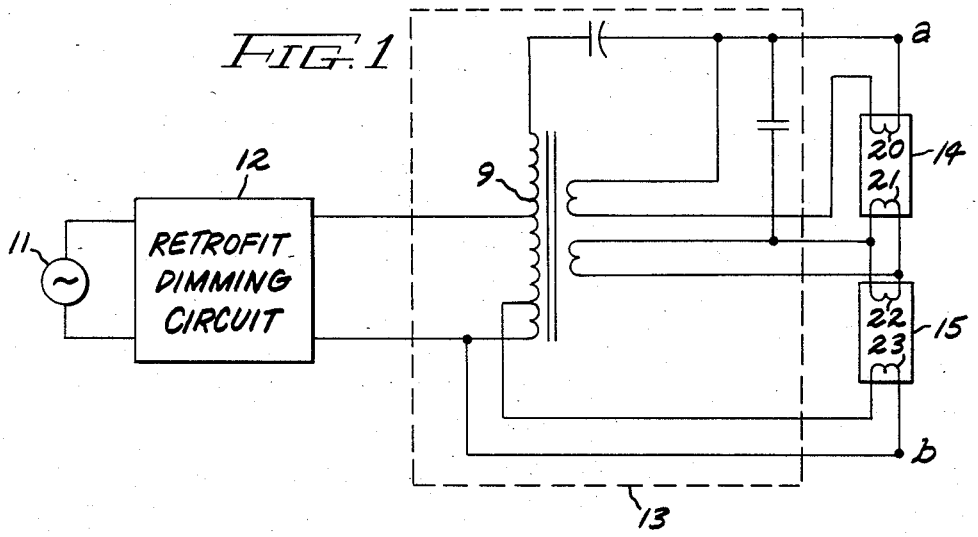
FIG. 1 is a partial schematic diagram of a fluorescent lighting system including a conventional ballast and showing the location of a retrofit fluorescent dimming system.

Referring now to the drawings, FIG. 1 is a part block diagram, part schematic of a retrofit fluorescent lamp energy management/dimming system according to the present invention. A retrofit dimming circuit 12 is shown between a low frequency AC source 11, typically a 60 hertz power line, and a conventional non-dimming rapid-start fluorescent ballast 13 (an 8G1022W ballast manufactured by the General Electric Co. is shown in the Figure). Ballast 13 powers series connected lamps 14 and 15 and filament heaters 20–23.

As previously stated, it is desirable to modify existing fluorescent lighting systems at the distribution panel level to achieve dimming. Thus, dimming circuit 12 is located in the incoming AC line and is suitable for use as a wallbox dimmer.

Figure 2:
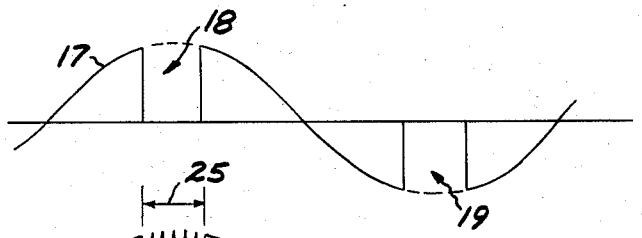
FIG. 2 (PRIOR ART)
FIG. 2 is a voltage waveform illustrating a prior art method for dimming fluorescent lamps.

FIG. 2 represents a waveform produced by prior art fluorescent dimmers. Voltage waveform 17 contains notches 18 and 19 which reduce the RMS value of voltage waveform 17. Notches 18 and 19 have been obtained, in the prior art, by opening a series switch in the AC line between the AC source and the ballast. Phase control is used to vary the width of the notches and variable dimming is realized. It is also known to form more than one non-conducting region (notch) in each half-wave as shown by the previously mentioned Spira et al. patent. However, these prior art schemes all lead to lower filament voltage and the resulting problems which were previously discussed.

Figure 3:
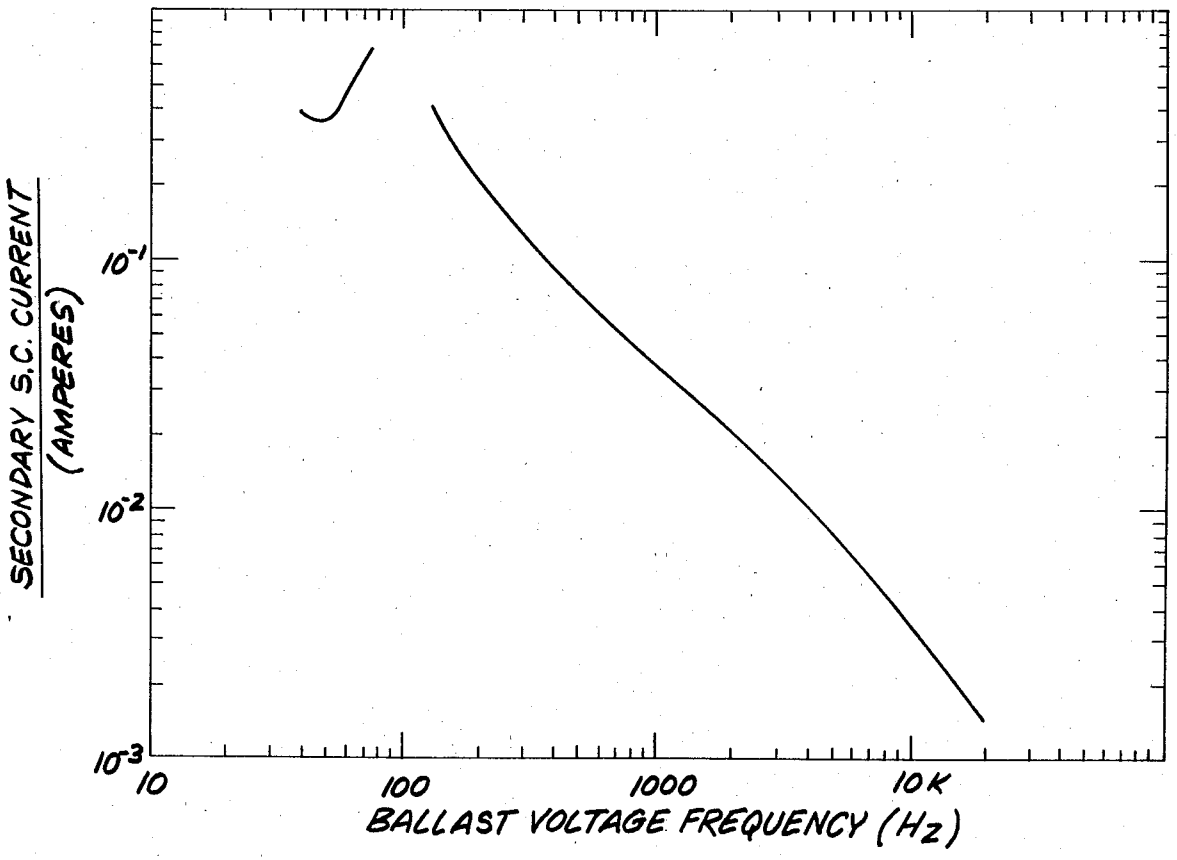
FIG. 3 is a graph showing a transfer characteristic of the ballast of FIG. 1.

The present invention avoids any reduction of filament voltage during lamp dimming by taking advantage of a particular property of the rapid-start ballast. FIG. 3 illustrates the transfer characteristic of ballast 13 obtained with a variable frequency 80 VAC supply. FIG. 3 plots short-circuit current measured between points a and b in FIG. 1, on a logarithmic scale, versus frequency of the voltage supplied to the ballast, also on a logarithmic scale. Providing a short-circuit instead of the lamps provides a satisfactory approximation of lamp current since the lamp has a negative volt-ampere characteristic. At 60 hertz, 120 VAC primary excitation, lamp current is approximately 390 mA while short-circuit current was measured at approximately 440 mA.

As evident from FIG. 3, ballast 13 acts as a low pass filter as seen by the lamp terminals. Although lamp current, i.e. filament-to-filament current, as approximated by a short-circuit, initially increases as frequency is increased from 60 hertz, short-circuit current is reduced by 50% at 190 hertz. At 10 times normal line frequency (600 hertz), short-circuit current falls to 60 mA (13.6% of the short-circuit current at 60 hertz). At 10 KHz, current falls to 3.6 mA, and at 20 KHz it falls to about 1 mA. However, as input frequency increases from 60 hertz to 20 KHz, filament voltage remains substantially constant—falling only from about 3.9 volts at 60 hertz to about 3.8 volts at 20 KHz. The stability of the filament voltage is a result of the filament secondary winding being closely coupled with the primary winding of the ballast transformer 9, shown in FIG. 1.

A first aspect of the present invention is that the lamps may be dimmed by lowering the duty cycle of the AC line voltage during each half cycle of line voltage and adding to the ballast voltage a high frequency component to maintain filament voltage either continuously or during the off portions of the duty cycle of the low frequency AC line voltage. The best overall results have been obtained when the high frequency component has a frequency greater than 10 times the AC line frequency. Thus, lamps 14 and 15 may be dimmed without any periods of zero energy transfer to lamp filaments 20–23. This method increases the lifetime of lamps which are operated in a dimmed condition nearly to the lifetime that they would have if they were operated at full power.

A first embodiment of the retrofit dimming circuit of the present invention will now be described with reference to the dimming circuit of FIG. 5 and the voltage waveforms of FIGS. 4A and 4B.

Figure 4A:
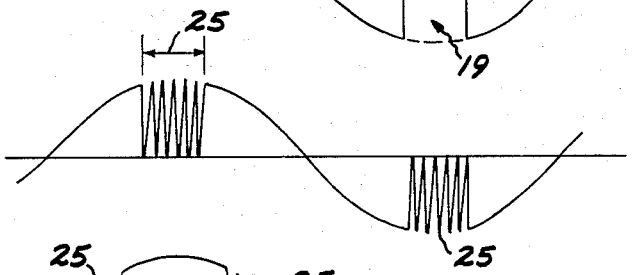
FIGS. 4A and 4B illustrate the ballast primary voltage waveform according to one embodiment of the present invention.
Figure 4B:
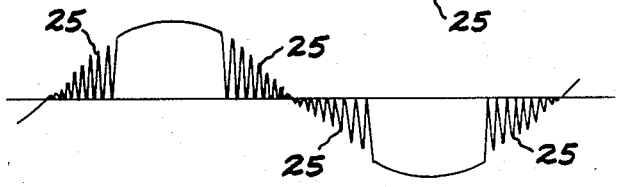

As shown in FIGS. 4A and 4B, high frequency pulses may replace the low frequency component for controlled intervals 25. Thus, a power switch 30 in FIG. 5 which is doing the low frequency power line modulation, i.e. notching of the voltage waveform, may also perform the high frequency power conditioning.

The low frequency voltage waveform needs to be constrained according to two guidelines. First, in order to avoid ballast resonances, no frequency component should be generated in the resonant range of the ballast, typically about 85 to 110 hertz, when reducing the low frequency line power.

Second, there should be negligible net DC after any full 60 hertz waveform. In other words, each half cycle should generate substantially equal light per half cycle to avoid the appearance of flicker.

As previously described, high frequency switching should occur at a frequency at least ten times the powerline frequency. The high frequency switching occurs during the low frequency lamp out times which may be placed at various portions of the low frequency waveform as shown in FIGS. 4A and 4B. Other locations of intervals 25 are possible such as at the trailing edge of each half wave only. Variable dimming of lamps 14 and 15 is achieved by varying the widths of intervals 25, i.e. changing the duty cycle of the low frequency component.

Figure 5:
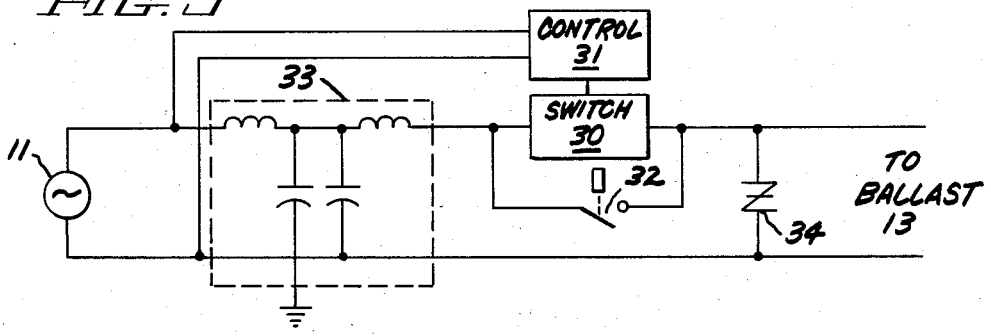
FIG. 5 is a circuit diagram of an exemplary dimming circuit which provides the waveforms of FIGS. 4A and 4B.

FIG. 5 shows power switch 30 in the AC line between AC source 11 and ballast 13. A control 31 is supplied by source 11 and is connected to switch 30. An EMI control 33 is shown for reducing electromagnetic interference with the power line generated by the dimming circuit. A high voltage bilateral trigger device, such as sidac 34 is provided across ballast 13 to clamp switch and load voltage.

If, as in the preferred embodiment, power switch 30 comprises a controlled unilaterally conducting power device within a diode bridge circuit, a relay 32 is provided across switch 30. Relay 32 is closed during periods that full energy consumption is allowed, i.e. no dimming, to avoid bridge conduction losses. A piezoelectric relay activator may be used to activate relay 32.

Figure 6:
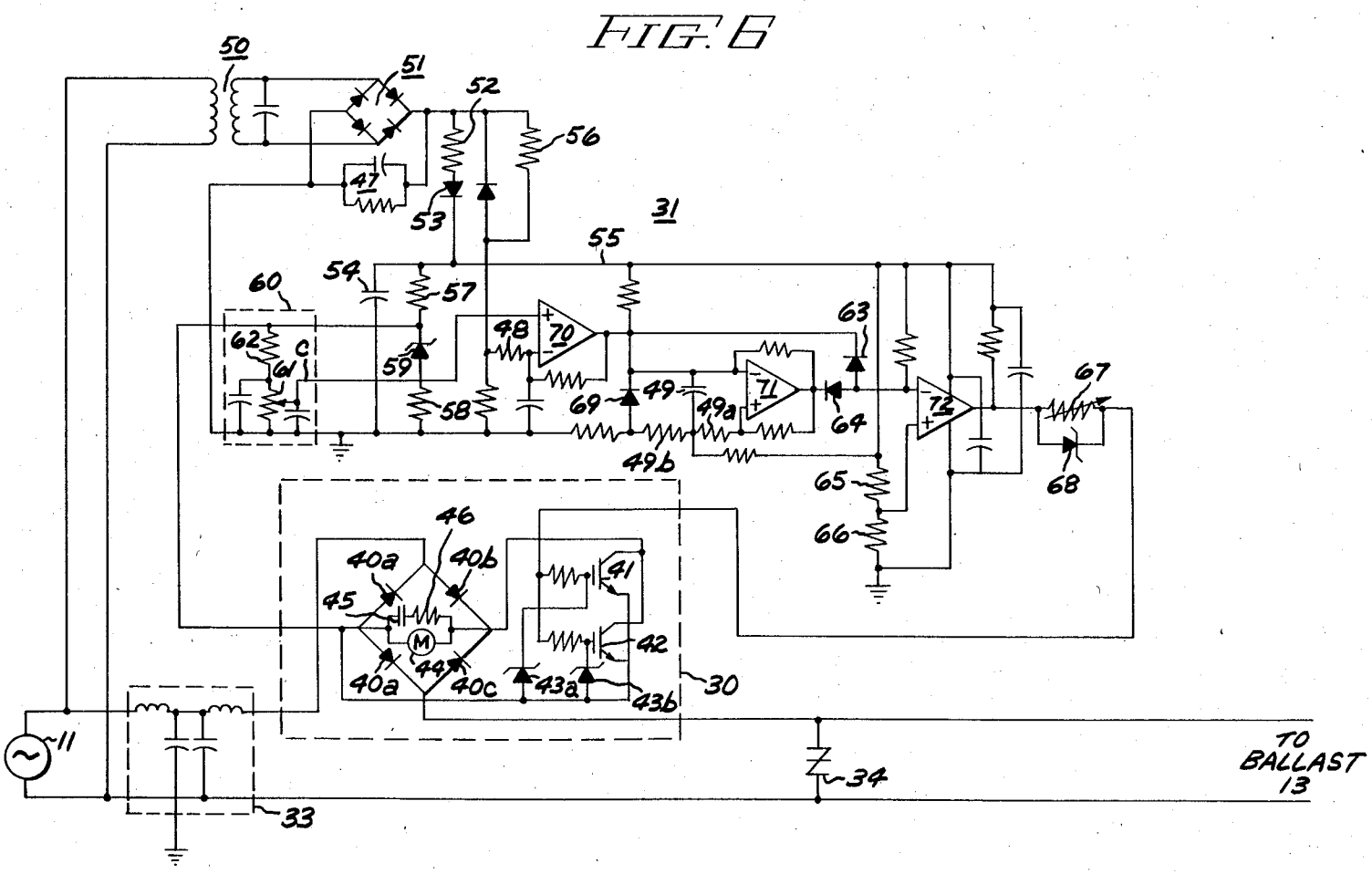
FIG. 6 is a circuit diagram showing the switch and control of FIG. 5 in greater detail.

Referring now to FIG. 6, switch 30 and control 31 are shown in greater detail. Switch 30 comprises a full-wave rectifying diode bridge including diodes **40*a*–40*d*. A pair of insulated gate transistors or IGT switching devices 41 and 42 are connected in parallel across the output of the diode bridge rectifier. The IGT is described in, for example, Baliga et al., The Insulated Gate Rectifier (IGR): A New Power Switching Device, IEEE/Int. Electron Devices Mtg., Dec. 1982, pp. 264–267. Two switching devices are used in parallel in order to avoid overheating of the switches but where overheating is not a problem one switching device may be used. A pair of zener diodes 43*a* and 43*b* clamp the gate voltage of IGTs 41 and 42. Voltage transients are suppressed by a metal oxide varistor 44 connected across the output of the rectifier and the series combination of a capacitor 45 and resistor 46** also connected across the output of the rectifier.

Other possibilities for power switches 41 and 42 are power FETs and GTOs. With the development of complementary blocking IGTs, full-on losses might be reduced to a value which could allow relay elimination.

Control circuit 31 will now be described with reference to FIG. 6. Control circuit 31 is supplied from AC source 11 through an isolation transformer 50. Full-wave rectified voltage is provided at the output of diode rectifier 51. A DC bus 55 is connected to the rectifier through small resistor 52 and diode 53 in series. The DC bus voltage is smoothed by a filter capacitor 54. A transient suppression circuit 47 controls voltage spikes appearing in control circuit 31.

A dimming control 60 receives a reference DC voltage through resistor 57. Series-connected resistor 58 and zener diode 59 provide dimming control 60 with partial compensation for line fluctuations. Resistor 62 and potentiometer 61 in dimming control 60 connected in series across the combination of resistor 58 and zener diode 59 provide a variable DC output at point c. Potentiometer 61 may be replaced by a voltage divider and a switch providing discrete levels of dimming.

Point c is connected to the non-inverting input of a comparator 70. Full wave rectified signals are provided to the inverting input of comparator 70 from rectifier 51 through series-connected resistors 56 and 48. Thus, square waves are provided at the output of comparator 70 which are high when the full wave rectified voltage produced by rectifier 51 and sensed through resistors 56 and 48 is below the voltage provided by dimming control 60. Thus, the width of the high portions of square waves provided by comparator 70 may be varied under control of dimming control 60.

The output of comparator 70 is supplied to the inverting input of an operational amplifier 71. Op amp 71 is connected to act as an oscillator when the output of comparator 70 is high. Timing capacitor 49, resistors **49*a* and 49*b* and diode 69 control the switching frequency of operational amplifier 71. Thus, high frequency pulses are provided at the output of operational amplifier 71 during periods that the variable DC level from dimming control 60 is higher than the full wave rectified voltage provided to the inverting input of comparator 70**.

The inverting input of an operational amplifier 72 is connected to the outputs of comparator 70 and operational amplifier 71 through diodes 63 and 64, respectively. The noninverting input of operational amplifier 72 is connected to a DC voltage proportional to line voltage on bus 55 reduced by a voltage divider comprising resistors 65 and 66. Thus, operational amplifier 72 acts as an inverter-combiner providing high frequency pulses during the leading and trailing edges of each half wave provided by rectifier 51 and a high level output during the remainder of each half wave.

The output of operational amplifier 72 is wave shaped by potentiometer 67 and zener diode 68 connected thereacross, the diode being polarized to provide a fast turn on and slow turn off time for switches 41 and 42. This wave shaping minimizes the electromagnetic interference generated. The wave shaped output of operational amplifier 72 constitutes a gating signal for IGTs 41 and 42 in switch 30. The emitters of IGTs 41 and 42 are also connected to the cathode of zener diode 59 in control 31.

High frequency pulses may be provided at the center of each half wave rather than in the vicinity of the zero crossings thereof by reversing the inputs to comparator 70.

Figure 7A:
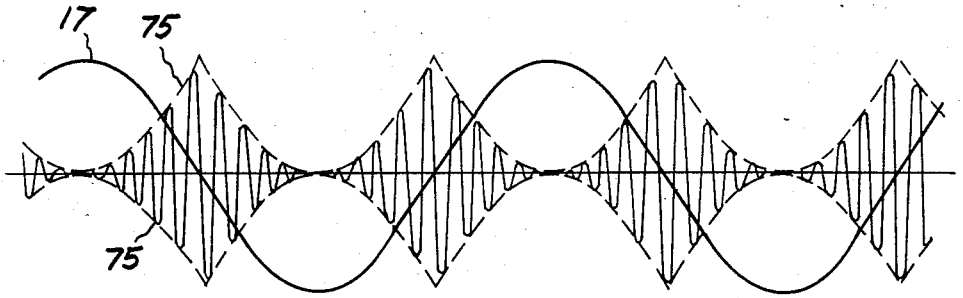
FIGS. 7A–7C are waveforms of the low frequency component and high frequency component of the ballast voltage in another embodiment.
Figure 7B:
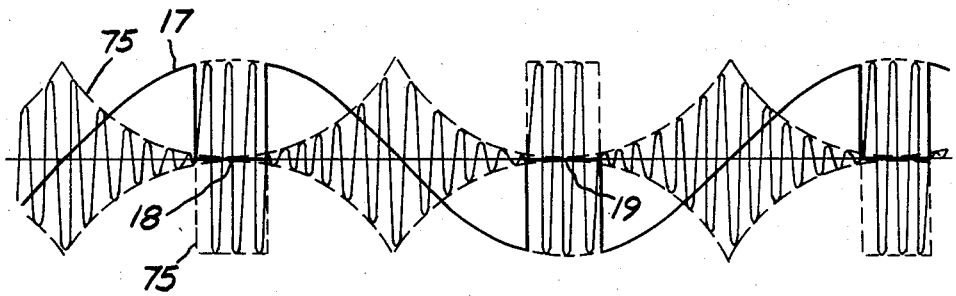
Figure 7C:
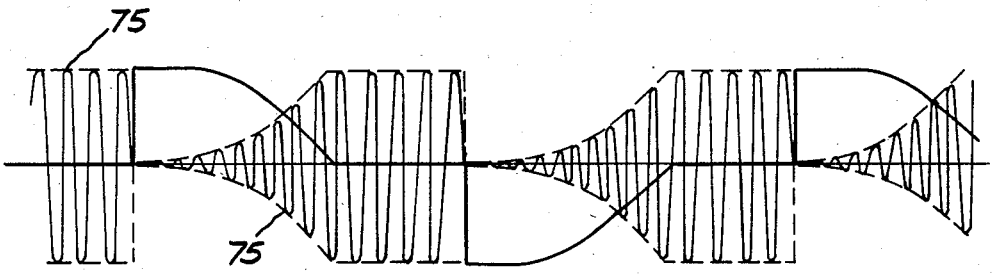

A further embodiment of the present invention will now be described for achieving a high frequency component having the waveforms shown in FIGS. 7A, 7B and 7C. Dashed lines 75 in FIGS. 7A–7C represent a modulation envelope for the high frequency component resulting in a substantially constant peak voltage when adding the high frequency component to the low frequency component. Thus, in FIG. 7A, voltage waveform 17 equals the AC line voltage since the low frequency component is not notched. Modulation envelope 75 has a shape such that the sum of modulation envelope 75 and the absolute value of waveform 17 equals a constant, namely the peak voltage of waveform 17.

As shown by FIGS. 7B and 7C, when the shape of the low frequency component of waveform 17 is changed under phase control, the shape of modulation envelope 75 changes so that peak voltage remains substantially constant. As a result, filament heating is maintained by the high frequency component of the ballast voltage without subjecting the system insulation to high peak voltages.

Figure 8:
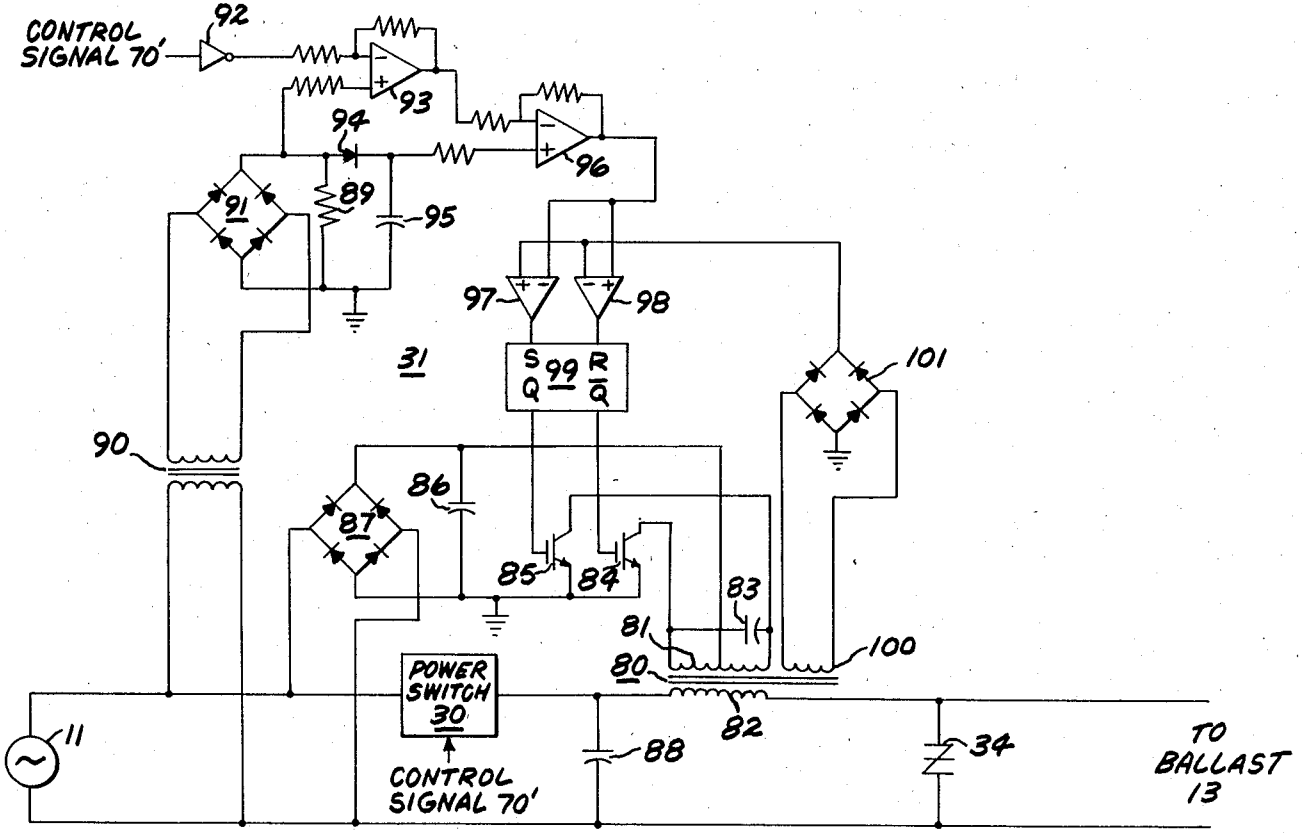
FIG. 8 is a circuit diagram of a dimming circuit which may be used to provide the waveforms of FIGS. 7A–7C.

FIG. 8 shows a preferred embodiment of a circuit for achieving the waveforms of FIGS. 7A–7C. The present dimming circuit includes power switch 30 connected to AC source 11 as previously described. Control signal 70' controls power switch 30. Control signal 70' may be provided, for example, by comparator 70 in FIG. 6. In this example, as in the previous example, when control signal 70' is high, power switch 30 is closed.

Transformer 80 is provided in the circuit of FIG. 8 for supplying a high frequency component of voltage to the ballast. Rectifier 87 and DC filter capacitor 86 provide a DC voltage to the center tap of transformer primary 81. Alternating current is induced in transformer secondary 82 by alternately closing switches 84 and 85, shown as IGTs although other semiconductor switches may be used. The rise and fall times of the alternating current induced in transformer secondary 82 are determined by the inductances of transformer 80 and the capacitance of a capacitor 83 connected across transformer primary 81. In the present invention, transformer 80 and capacitor 83 are chosen to provide a high frequency component having a frequency from 10–160 times the 60 hertz AC input voltage as determined by the rise and fall times within the modulation envelope. A high frequency short circuit is provided by capacitor 88 so that the high frequency component does not appear in power switch 30 or the building wiring.

The remainder of the dimming circuit shown in FIG. 8 controls the switching of switches 84 and 85. A diode rectifier 91 is coupled to AC source 11 through an isolation transformer 90. The rectified voltage from rectifier 91, stabilized by a resistor 89, is provided to the non-inverting input of an operational amplifier 93. Control signal 70' is provided to an inverter 92. The output of inverter 92 is provided to the inverting input of operational amplifier 93. The output of operational amplifier 93 is provided to the inverting input of an operational amplifier 96. DC voltage rectified by rectifier 91 and filtered by a DC filter 95 is provided to the non-inverting input of operational amplifier 96. Diode 94 prevents filtered DC from appearing at the non-inverting input of operational amplifier 93. The output of operational amplifier 96 is the modulation envelope for the high frequency component supplied to ballast 13 by transformer 80. Thus, the output of operational amplifier 96 is proportional to the difference between the peak voltage of AC source 11 and the low frequency component supplied to ballast 13 by power switch 30.

The output of operational amplifier 96 is coupled to the inverting input of a comparator 97 and the noninverting input of a comparator 98. A pickup coil 100 measures the voltage across transformer secondary 82. The voltage sensed in pickup coil 100 is rectified by bridge rectifier 101 and supplied to the noninverting input of comparator 97 and the inverting input of comparator 98. The output of comparator 97 is coupled to the S input of SR flip-flop 99. The output of comparator 98 is coupled to the R input of flip-flop 99. The Q output of flip-flop 99 controls switch 85 and the not Q output of flip-flop 99 controls switch 84. Thus, high frequency voltages are generated within the modulation envelope provided by operational amplifier 96.

From the foregoing it is seen that voltage to ballast 13 is provided with a low frequency component having a variable duty cycle for dimming lamps 14 and 15 (shown in FIG. 1) in addition to a high frequency component which is modulated to provide substantially constant peak voltage to the ballast and which maintains filament heating during dimming of the lamps.

Figure 9:
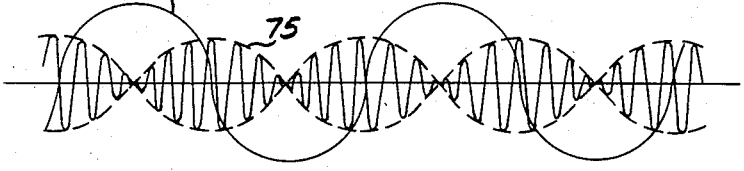
FIG. 9 shows waveforms of the high frequency component modulation envelope for an alternative embodiment.

FIG. 9 shows the output voltage produced by another embodiment of the dimming circuit of the present invention, wherein a high frequency component is added to the ballast voltage. Thus, a modulation envelope 75 for the high frequency component is obtained by phase shifting the AC line input voltage by 90°. By so doing, it is possible to have a peak ballast voltage higher than the peak voltage of waveform 17 although less than some other predetermined value. Such predetermined value is determined by the maximum value of the sum of waveform 17 and modulation envelope 75 considered over a full cycle of waveform 17.

Figure 10:
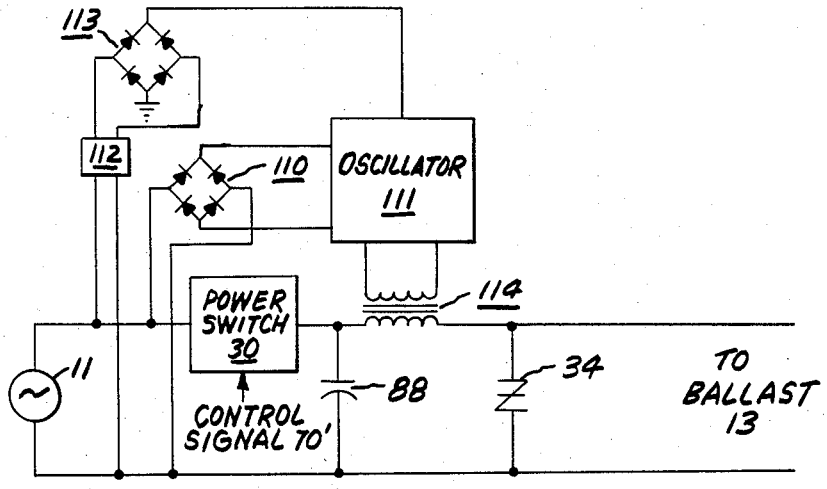
FIG. 10 is a circuit diagram of a dimming circuit which may be used to provide the modulation envelope of FIG. 9.

A dimming circuit for providing the high frequency component shown in FIG. 9 is illustrated in FIG. 10. A power switch 30 is controlled by a control signal 70' as in previously described embodiments. A bridge rectifier 110 supplies dc power to an oscillator 111. Phase shifter 112 provides a signal shifted 90° from the AC input voltage provided by AC source 11. The signal from phase shifter 112 is rectified by bridge rectifier 113 and the rectified signal is provided as a modulation envelope for oscillator 111. The high frequency component from oscillator 111 is added to the ballast voltage through a coupling transformer 114. A protective high frequency short-circuit is provided by capacitor 88 in the manner described in the previously-considered embodiment.

Figure 11:
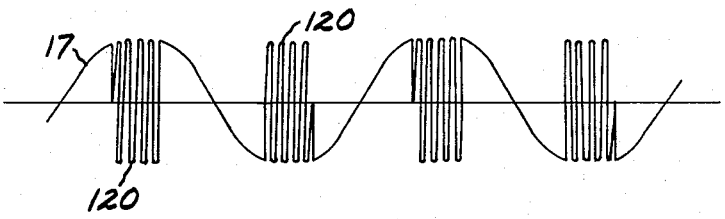
FIG. 11 shows a waveform of the ballast primary voltage of yet another embodiment of the present invention.
Figure 12:
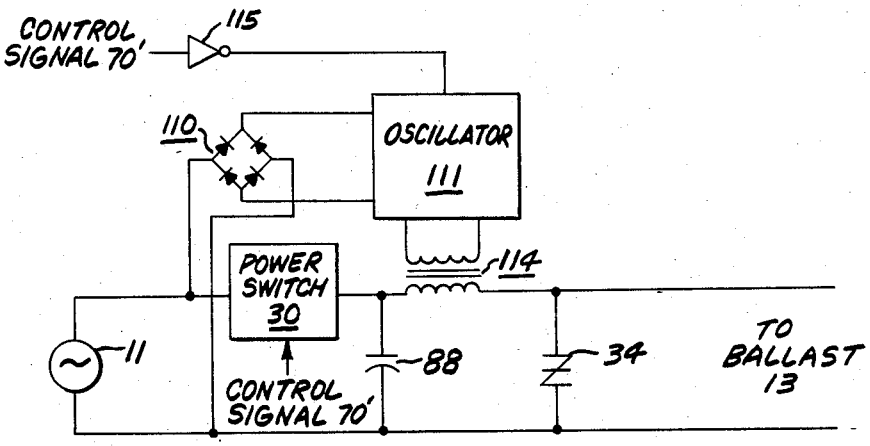
FIG. 12 is a circuit diagram of a dimming circuit which may be used to provide the waveform of FIG. 11.

Yet another embodiment of the present invention provides the waveform shown in FIG. 11. In this embodiment only the notches in waveform 17 are filled in with high frequency voltages 120. Thus, the modulation signal for oscillator 111 is produced by inverter 115 which inverts control signal 70' by virtue of the circuitry shown in FIG. 12 and described in conjunction with FIG. 10.

In all of the embodiments described above, filament heating is maintained during the dimming of fluorescent lamps, all in a retrofit system. By maintaining adequate filament heating the lamps are dimmed without subjecting them to adverse conditions leading to hard starting and reduced lamp life.

While preferred embodiments of the present invention have been shown and described herein, it will be obvious that such embodiments are provided by way of example only. Numerous variations, changes, departures, substitutions and partial and full equivalents will now occur to those skilled in the art without departing from the invention herein. Accordingly, it is intended that the invention be limited only by the spirit and scope of the appended claims.

What is claimed is:

1. A method for maintaining filament heating in a fluorescent lamp dimming system wherein a dimming circuit supplied by an AC line source supplied voltage to a ballast for a fluorescent lamp, the ballast voltage including a low frequency component having a variable duty cycle during each half wave thereof to dim said lamp said low frequency component being passed through said ballast to said lamp and to the filaments of said lamp, said method comprising the steps of:

adding a high frequency component to said ballast voltage, at least during times that said low frequency component is insufficient to maintain filament heating, said high frequency being greater than the resonant frequency of said ballast; and restricting said high frequency component to cause current flow substantially only in the filaments of said lamp, whereby the filament voltage is maintained while the filament-to-filament current through said lamp is substantially unaffected by said high frequency component.

2. The method of claim 1 wherein said high frequency component is derived by very rapidly switching on and off said current from said AC source for controlled periods, simultaneously establishing said high frequency component and said duty cycle of said low frequency component.

3. The method of claim 1 wherein said high frequency component is derived from a high frequency signal modulated to provide a substantially constant peak ballast voltage when added to said low frequency component having a varied duty cycle.

4. The method of claim 1 wherein said high frequency component is derived from a high frequency signal added to said ballast voltage substantially only during the off periods of said duty cycle.

5. The method of claim 1 wherein said high frequency component is derived from a high frequency signal modulated by a full-wave rectified signal from said AC source phase shifted by 90°;

whereby voltage peaks across said ballast substantially in excess of a predetermined value are avoided.

6. A dimming circuit connected in an AC line between a low frequency AC source and a fluorescent lighting system, said lighting system including a conventional transformer ballast for supplying voltage to a fluorescent lamp and filaments thereof, said dimming circuit comprising:

a power switch in said AC line for selectively coupling said AC source to said ballast; and a control circuit coupled to said power switch, said control circuit providing high frequency switching signals to said power switch to turn said power switch on and off at said high frequency for controlled intervals during each half cycle of said AC source, said control circuit turning on said power switch during the remaining portions of each half cycle, said high frequency being greater than the resonant frequency of said ballast;

whereby substantially constant power is supplied to said filaments via high frequency and low frequency components of voltage supplied to said ballast while the power suppled to said lamp via said low frequency component of voltage supplied to said ballast is variably reduced.

7. A dimming circuit in accordance with claim 6 wherein said power switch is switched on and off during said controlled intervals at a frequency in the range of 600 hertz and higher.

8. A dimming circuit in accordance with claim 6 wherein said power switch comprises a semiconductor switching element connected within a bridge circuit.

9. A dimming circuit in accordance with claim 8 further including a relay connected across said power switch adapted to close during periods of no dimming to reduce bridge conduction losses.

10. A dimming circuit in accordance with claim 8 wherein said semiconductor switching element comprises an IGT.

11. A dimming circuit in accordance with claim 6 further including a bilateral trigger device connected across said ballast.

12. A dimming circuit for connecting in a first AC line between a low frequency AC source and a conventionally ballasted fluorescent lighting system, comprising:

a power switch adapted to be connected in said AC line for varying the duty cycle of the voltage of said low frequency AC source supplied to the ballast of said lighting system;

high frequency voltage providing means adapted to be connected in said first AC line between said power switch and said ballast for supplying a high frequency component to said ballast, said high frequency component being modulated to provide a substantially constant peak voltage when added to the voltage provided by said power switch; and a high frequency short-circuit adapted to be connected between the junction of said power switch and said high frequency voltage providing means and the other AC line of said low frequency AC source.

13. A dimming circuit in accordance with claim 12 wherein said high frequency component has a frequency in the range of 600 hertz and higher.

14. A dimming circuit in accordance with claim 12 wherein said power switch comprises a semiconductor switching element connected within a bridge circuit.

15. A dimming circuit in accordance with claim 14 further including a relay connected across said power switch adapted to close during periods of no dimming in order to reduce bridge conduction losses.

16. A dimming circuit in accordance with claim 14 wherein said semiconductor switching element comprises an IGT.

17. A dimming circuit in accordance with claim 12 further including a bilateral trigger device connected across said ballast.

18. A dimming circuit for connecting in a first AC line between a low frequency AC source and a transformer ballasted fluorescent lighting system comprising:

a power switch adapted to be connected in said first AC line for varying the duty cycle of the voltage of said low frequency AC source supplied to the ballast of said lighting system;

a high frequency oscillator for providing a voltage having a frequency in the range of 600 hertz and higher;

coupling means adapted to couple the output of said oscillator to said first AC line between said power switch and said ballast during periods of said duty cycle when said power switch is nonconductive; and a high frequency short-circuit adapted to be connected between the junction of said power switch and said coupling means and the other AC line of said AC source.

19. A dimming circuit for connecting in a first AC line between a low frequency AC source and a conventionally ballasted fluorescent lighting system, comprising:

a power switch adapted to be connected in said first AC line for varying the duty cycle of the voltage of said low frequency AC source supplied to the ballast of said lighting system;

a high frequency oscillator for providing a voltage having a frequency at least 10 times greater than said AC source frequency;

means coupled to said oscillator for modulating said voltage from said oscillator inversely as the amplitude of said AC source;

circuit means adapted to couple the output of said oscillator to said first AC line between said power switch and said ballast; and a high frequency short-circuit adapted to be connected between the junction of said power switch and said circuit means and the other AC line of said AC source.

20. A dimming circuit for connecting in an AC line between a low frequency AC source and a fluorescent lighting system, said lighting system including a conventional transformer ballast for supplying voltage to a fluorescent lamp and filament thereof, said dimming circuit comprising:

a power switch adapted to be connected in said AC line for selectively coupling said AC source to said ballast; and a control circuit coupled to said power switch, said control circuit providing high frequency switching signals to said power switch to turn said power switch on and off at said high frequency for controlled intervals during each half cycle of said AC source, said control circuit turning on said power switch during the remaining portions of each half cycle, said high frequency being greater than the resonant frequency of said ballast;

whereby substantially constant power is supplied to said filaments via high frequency and low frequency components of voltage supplied to said ballast while the power supplied to said lamp via said low frequency component of voltage supplied to said ballast is variably reduced when said dimming circuit is connected to said lighting system.

21. A dimming circuit in accordance with claim 20 wherein said power switch comprises a semiconductor switching element connected within a bridge circuit.

22. A dimming circuit in accordance with claim 20 wherein said semiconductor switching element comprises an IGT.

23. A dimming circuit in accordance with claim 20 further including a bilateral trigger device connected across said ballast.

* * * * *